United States Patent [19]

Hirsch

[11] Patent Number: 4,597,138

[45] Date of Patent: Jul. 1, 1986

[54] CONNECTING MEMBER FOR STRAPS, BANDS OR THE LIKE

[76] Inventor: Hermann Hirsch, Hirschstrasse 5, 9021 Klagenfurt, Karnten, Austria

[21] Appl. No.: 690,469

[22] Filed: Jan. 10, 1985

[30] Foreign Application Priority Data

Feb. 15, 1984 [AT] Austria ..... 490/84

[51] Int. Cl.[4] ..... A44C 5/14

[52] U.S. Cl. ..... 24/265 B; 24/265 WS; 24/71 J; 24/585; 24/629

[58] Field of Search ..... 24/265 B, 265 WS, 68 J, 24/69 J, 70 J, 71 J, 116 A, 629, 617, 585, 237

[56] References Cited

U.S. PATENT DOCUMENTS

| | | | |
|---|---|---|---|
| 1,629,040 | 5/1927 | McGrevy | 24/265 B |
| 1,709,179 | 4/1929 | Lederer | 24/265 WS |
| 1,836,772 | 12/1931 | Rossman | 24/265 WS |
| 2,653,369 | 9/1953 | Rodriguez | 24/265 B |
| 2,676,379 | 4/1954 | Hornreich . | |
| 3,073,492 | 1/1963 | Berger | 24/265 B |
| 3,705,456 | 12/1972 | Bruner | 24/265 B |

FOREIGN PATENT DOCUMENTS

| | | | |
|---|---|---|---|
| 772480 | 10/1934 | France | 24/265 B |
| 1014298 | 8/1952 | France | 24/265 B |
| 1042248 | 10/1953 | France . | |
| 2408322 | 6/1979 | France . | |
| 2429571 | 1/1980 | France . | |
| 311956 | 5/1929 | United Kingdom . | |

*Primary Examiner*—Victor N. Sakran
*Attorney, Agent, or Firm*—Young & Thompson

[57] ABSTRACT

A connecting member (1, 16, 20) consisting of at least two pivotably joined parts is suggested for the attachment of straps (2) to watches (3). In this arrangement, the mutually pivotable parts (6, 7; 17, 7; 21, 22) exhibit surfaces (14, 15) in contact with each other under spring pressure and having locking tabs and locking recesses, so that the parts (6, 7; 17, 7; 21, 22) of the connecting member (1, 16, 20) are releasably locked together at least after a pivoting by 180°.

4 Claims, 10 Drawing Figures

Figure 7:
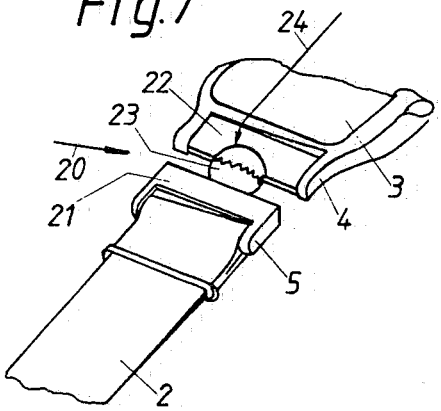

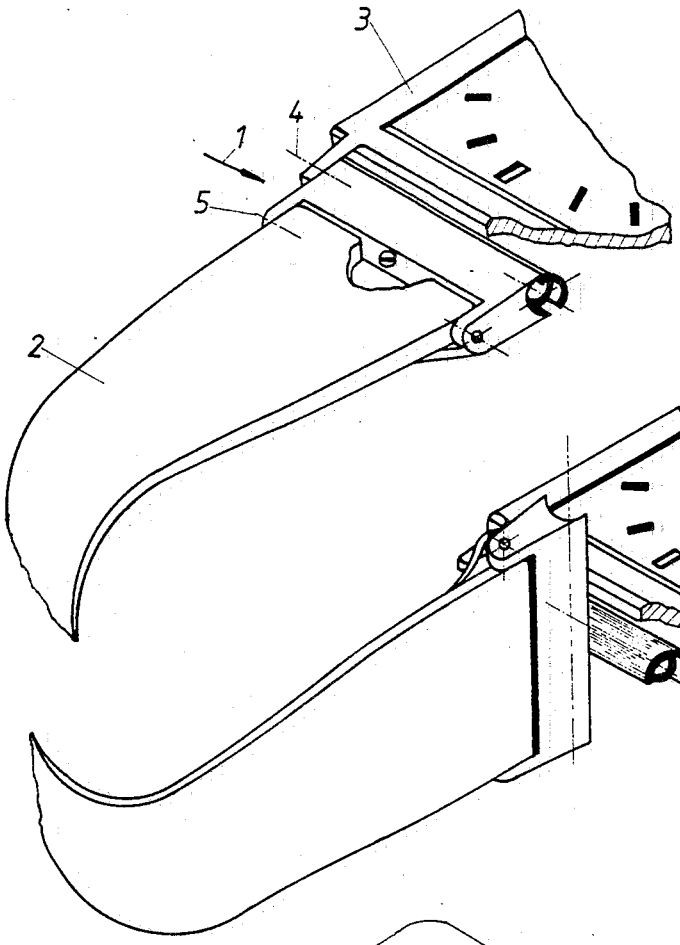
Fig. 1
Fig. 2
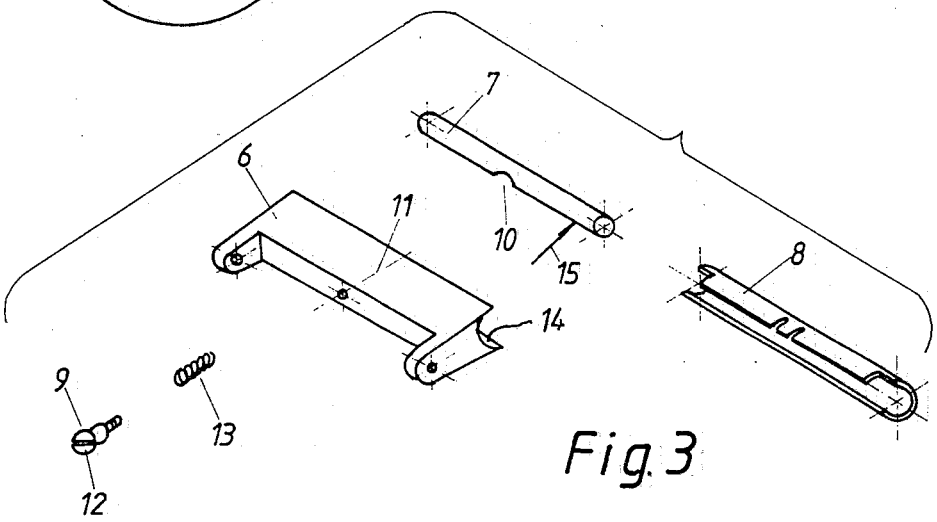
Fig. 3

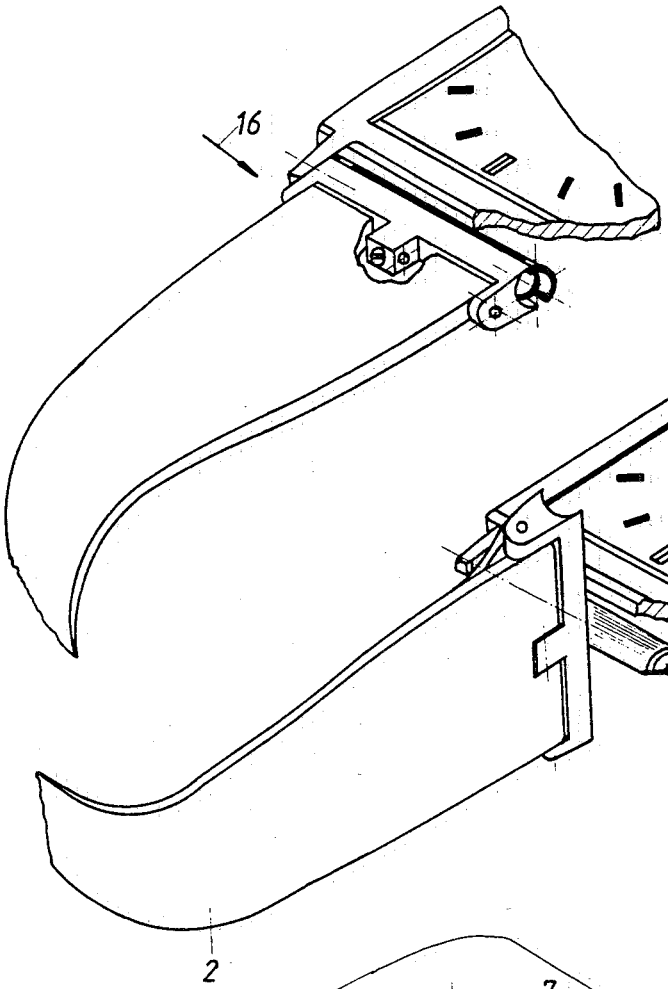
Fig. 4
Fig. 5
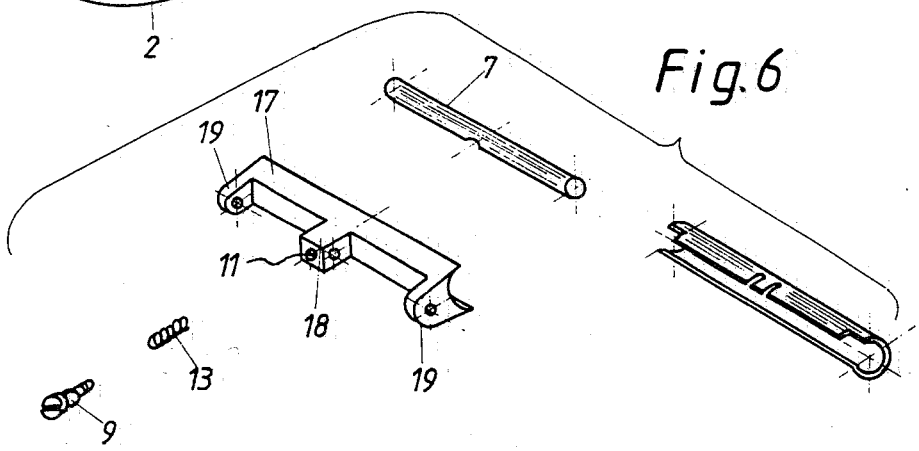
Fig. 6

CONNECTING MEMBER FOR STRAPS, BANDS OR THE LIKE

The invention relates to a connecting member for straps, by means of which the strap can be joined to articles, for example to the housing of a watch, the connecting member consisting of at least two parts pivotably connected with each other and the axis, about which the two parts of the connecting member can be pivoted with respect to each other, lying preferably in the longitudinal center line of the strap.

Straps, bands, or the like, which can be worn in a reversible fashion, are conventional. If such straps are attached to an article having a distinct topside and bottom side as is the case, for example, in watchbands for watches, then the turning of the strap has heretofore been rather complicated since the strip must be detached from the article and, after turning, must be reattached.

Watches having bracelet-like hoops have been known from French Pat. No. 2,408,322 and French Pat. No. 2,429,571 wherein the watches are rotatably attached to the ends of the hoops. For this purpose, French Pat. No. 2,408,322 provides a ball joint and French Pat. No. 2,429,571 provides a screw connection and a hook-locking connection. Turning of the bracelet is not intended. Furthermore, French Pat. Nos. 2,408,322 and 2,429,571 do not disclose any measures permitting the securing of a selected rotational position.

The invention is based on the object of providing a connecting member for straps, bands or the like permitting a turning of the strap without any problems and in a simple way, i.e. a rotating of the strap with respect to the article, e.g. the watch.

According to the invention, this is achieved in a connecting member of the type discussed above by providing that the two mutually pivotable parts of the connecting member exhibit surfaces that face each other and are in contact with each other, that the surfaces are urged toward each other by at least one spring, and that means are provided in the form of locking tabs and corresponding locking recesses on the mutually contacting surfaces of the parts for locking together the two parts of the connecting member at least after a pivoting by 180°.

In the arrangement of the connecting member according to this invention, the strap, attached by way of this connecting member to an article, can be reversed by a simple rotation about the longitudinal axis of the strap. It is no longer necessary to detach the strap from the article for turning purposes, which in some cases is impossible anyway without destruction of the strap, for example in case of watchbands glued, with formation of loops, around fixed webs of watches.

Thanks to the locking means (locking tabs and recesses) provided according to this invention, the strap after turning by 180° is maintained in the desired rotational position with respect to the article to which it is attached.

The interlocking of the flexibly connected parts of the connecting member can take place, within the scope of this invention, also by fashioning one of the two mutually contacting surfaces to be convex and the other to be correspondingly curved in a concave way. In this arrangement, an embodiment has proven itself wherein the surfaces are curved about an axis extending transversely to the longitudinal center line of the strap.

The connection of the connecting member to the article to which the strap is to be attached becomes especially simple if the part of the connecting member, facing the article to which the strap is to be attached via the connecting member, is designed as a hollow cylinder. For in this case it is sufficient to pass a crosspiece, for example a spring pin, through the hollow cylinder of the connecting member.

In order to adapt the connecting member to varying widths of the connecting members fashioned at the article, for example differing widths of watch mountings, the provision can be made that a cover member is placed over the hollow cylinder.

In one embodiment of the invention, the provision is made that the part of the connecting member to be fastened to the strap is joined to the strap by way of at least one crossbar which is fashioned, for example, as a spring pin.

However, it is also possible within the scope of the invention to join the part of the connecting member that is attached to the strap to the latter by means of gluing. In this arrangement, the connection between the connecting member and the strap can be effected exclusively by glueing, but it is also possible alternatively, according to a further embodiment of the invention, to join the part of the connecting member that is attached to the strap to the latter by means of a flexible tension-relief member affixed to the strap, particularly between the top material and the lining of the strap; the tension-relief member can be designed preferably as a high-tensile-strength woven band, as a high-tensile-strength film, or as threads extending in the longitudinal direction of the strap, which threads are optionally mounted on a substrate.

The flexible connection of the two parts of the connecting member can be designed in various ways. Well proven within the scope of this invention is an embodiment wherein a bore is provided in one of the two parts, preferably in the part of the connecting member to be attached to the strap, this bore receiving a compression spring; the latter is clamped in place between an annular shoulder in the bore and the head of a pin penetrating the bore, for example a screw, and the pin, the head of which is preferably likewise accommodated in the bore, is mounted, for example threaded in place, in the other part, preferably in the part of the connecting member to be affixed to the article.

The invention also covers an embodiment wherein the two parts of the connecting member are designed as bars oriented essentially transversely to the longitudinal extension of the strap, these bars being joined by way of, for example, approximately hemispherical projections, the surfaces of the parts with the locking means, by way of which the parts are in contact with each other, being constituted by the free end faces of the projections, especially the basal areas of the hemispheres.

If the strap, joined with an article via the connecting member of this invention, is a strap carrying at its free end a closure member for connecting same with a perforated part of another strap or strap section, as is the case, for example, in watchbands mounted to a watch, then a closure member is advantageous within the scope of this invention which is characterized in that it is designed symmetrically with respect to its axle, by way of which it is joined to the strap, and that the movable spike seated on the axle is designed to be straight, following its eye encompassing the axle. This lock design can be opened and closed by the user of the strap in a way customary for spike closures, independently of the side of the strap pointing upwardly (outwards).

Figure 8:
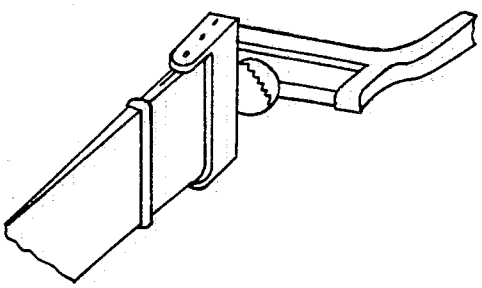
Figure 10:
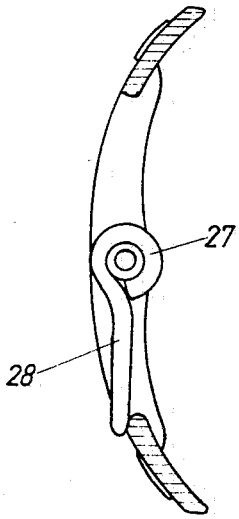
Figure 9:
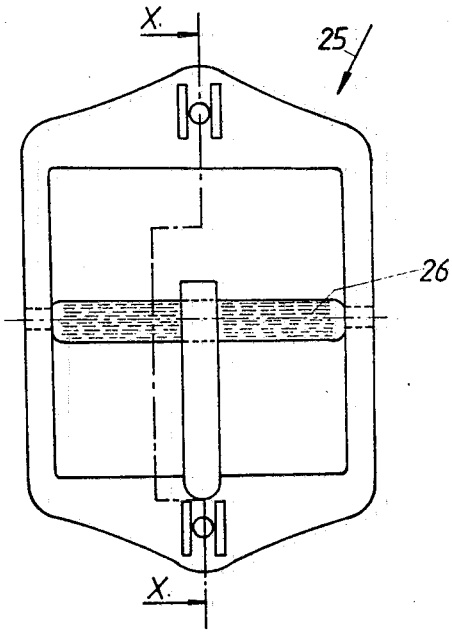

Additional details and features of the invention can be seen from the following description of preferred embodiments of the invention. In the drawings:

FIG. 1 shows a strap attached to a watch by way of a connecting member and fashioned as part of a watchband, FIG. 2 shows the connecting member of FIG. 1 in a partially turned position, FIG. 3 shows, in an exploded view, the details of the connecting member shown in FIGS. 1 and 2, FIG. 4 shows another embodiment of a connecting member, using as example the attachment of a watchband to a watch, FIG. 5 shows the connecting member of FIG. 4 in a partially turned position, FIG. 6 shows the connecting member of FIGS. 4 and 5 in an exploded view, FIGS. 7 and 8 show a third embodiment of a connecting member in various positions, FIG. 9 shows a closure member in a top view, and FIG. 10 shows the closure member of FIG. 9 in a sectional view along line X—X in FIG. 9.

It is first to be noted that, although the invention will be described below with reference to its preferred usage area, namely the joining of watchbands to watches, the invention is not limited to watchbands and/or their connection to watches but rather is intended and usable quite generally for straps, bands or the like to be joined to articles.

The connecting member 1 shown in FIG. 1 serves for connecting a watchband 2 with a watch 3. As can be seen from FIGS. 1 and 2, the connecting member 1 is joined to the watch 3 as well as to the watchband 2 by way of pins 4 and 5, respectively (indicated merely as axes in the drawing). The pins 4 and 5 can be designed as conventional spring pins. As shown in FIG. 3, the connecting member 1 consists of a part 6 intended for attaching the strap 2 to the connecting member 1 and of a part 7 which, in the illustrated embodiment, is fashioned as a hollow cylinder through which extends the spring pin 4 via which the connecting member 1 is joined to the watch 3. A shield 8 fashioned as a slotted spring sleeve is placed over the part 7 of the connecting member 1 fashioned as a hollow cylinder, in order to cover the latter. The shield 8 can also be designed to be wider than the connecting member 1 so that a connecting member 1 having one and the same width can be utilized for differently broad watch mountings by selection of a corresponding cover member 8.

The parts 6 and 7 of the connecting member 1 are joined together by a screw 9 threaded into a threaded bore 10 of part 7. The screw 9 passes through a staggered bore in part 6, there being inserted a coil spring 13 between the annular shoulder of the staggered bore 11 and the head 12 of the screw 9. The two parts 6 and 7 of the connecting member 1 are held in resilient contact with each other by the coil spring 13.

Due to the feature that the mutually facing surfaces 14 (part 6) and 15 (part 7) are designed to be curved and are urged against each other by the spring 13, the position of the strap 2 with respect to the watch 3 as shown in FIG. 1 is secured, since the raised (convex) surface 15 of part 7, acting as a locking tab, engages into the recessed (concave) surface 14 of part 6 serving as a locking recess.

In order to turn the strap 2 with respect to the watch 3, it is sufficient to seize part 6 of the connecting member 1 and twist same about the axis defined by the screw 9 with respect to part 7 of the connecting member 1 joined to the watch 3. As soon as part 6 has been rotated with respect to part 7 by 180°, the convexly shaped surface 15 of part 7 engages the concavely designed surface 14 of part 6 so that the band 2 is held in alignment in the desired position with respect to the watch 3.

The embodiment of a connecting member 16 shown in FIGS. 4–6 differs from the embodiment illustrated in FIGS. 1–3 by a different configuration of the part 17 of the connecting member 16 to be joined to the band 2. The part 17 of the connecting member 16 exhibits, as can be seen especially from FIG. 6, a cehtral projection provided with the bore 11 accommodating the screw that connects part 17 with part 7 of the connecting member 16. Due to the fact that the bore 11 is provided in the projection 18 of part 17, the web of part 17, extending transversely to the strap 2, can be fashioned to be narrower without impairing the secure connection of parts 7 and 17. The connection of part 17 with the strap 2 can take place by way of one or selectively by way of two spring pins inserted between the projections 18 and 19.

The mutually facing surfaces of the mutually rotatable parts of the connecting member of this invention need not be fashioned as illustrated in FIGS. 1–6. It is also possible to provide planar faces exhibiting locking tongues and corresponding locking recesses engaged by the locking tongues in the desired rotational position. It is furthermore not necessary for the surfaces, via which the two parts of the connecting member contact each other, to extend over the entire length and/or thickness of the connecting member. Such an embodiment is shown, by way of example, in FIGS. 7 and 8.

The connecting member 20 shown in FIGS. 7 and 8 consists of two parts 21 and 22 fashioned essentially in the form of bars; these parts are connected with the band 2 and with the watch 3, respectively, via spring pins 4 and 5, respectively. Each part 21 and 22 of the connecting member 20 has, approximately in its center, a projection 23 and 24 pointing respectively to the opposed part; the projections 23, 24, as in the illustrated embodiment, are designed to be of a substantially hemispherical shape. The basal surfaces of projections 23 and 24, i.e. the mutually facing surfaces of parts 21 and 22 of the connecting member 20, are in mutual contact under spring tension; the connection can be designed, for example, as illustrated in FIGS. 3 and 6, respectively. It can be seen from FIGS. 7 and 8 that the mutually facing surfaces of the projections 23 and 24 are provided with radially extending fluting so that the desired rotational position of the band 2 with respect to the watch 3 is releasably retained by reciprocal engagement of ribs into opposed indentations. It is understood that, in place of the plurality of ribs and/or grooves in the basal surfaces of the projections 23 and 24, other detent means can likewise be provided, which engage in a locking fashion after a revolution by 180°, similarly as in the embodiments of FIGS. 1–6.

A closure means usable with preference in conjunction with the bands equipped with the connecting members of this invention is illustrated in FIGS. 9 and 10. As can be seen therefrom, the closure means 25 is fashioned to be symmetrical with respect to its axle 26. Since the spike 28, seated with its eye 27 on the axle 26, simultaneously intended for attaching the closure means 25 to a band, is likewise fashioned to be straight, the closure means can be used bilaterally. In order to prevent the closure means 25 from extending away from the band with its part not contacted by the spike 28 in the respective in-use position—which is especially important in case of bands displaying a relatively strong curvature in their in-use position, such as watchbands—the closure means is fashioned to be curved in a convex way as seen from above. It is normally sufficient to design the closure means 25 to be convexly curved toward one direction, the axis of curvature extending approximately in parallel to the axle 26 of the closure means 25.

I claim:

1. Connecting means for straps, by means of which a strap can be connected to an article, the connecting means comprising two parts one of which is secured to a said strap, and means pivotally interconnecting the two parts for pivotal movement relative to each other about an axis on the longitudinal centerline of the strap, the two parts having mutually facing and mutually contacting surfaces, a said surface on one said part being concave and a said surface on the other said part being convex, said surfaces being bent about an axis disposed transverse to said longitudinal centerline, said surfaces having two positions in which said convex surface nests within said concave surface, said two positions being spaced 180° apart, and spring means urging said two parts toward each other thereby yieldably to maintain said two parts in one or the other of said two positions, said parts being movable away from each other against the action of said spring means, in a direction parallel to said centerline, to permit relative pivotal movement between said two positions.

2. Connecting means as claimed in claim 1, said spring means comprising a coil compression spring surrounding a pivot shaft that interconnects said two parts.

3. Connecting means as claimed in claim 1, said shaft extending through said part to which the strap is secured and being secured to the other said part.

4. Connecting means as claimed in claim 1, said part other than the part to which the strap is attached comprising a hollow cylinder over which a cover member is disposed.

* * * * *